US005592266A

United States Patent [19]

Park et al.

[11] Patent Number: 5,592,266

[45] Date of Patent: Jan. 7, 1997

[54] ELECTROPHOTOGRAPHIC PROCESS CARTRIDGE

[75] Inventors: Dong-Hoon Park, Kyungki-do; Dong-Ho Lee, Suwon, both of Rep. of Korea

[73] Assignee: SamSung Electronics Co., Ltd., Suwon, Rep. of Korea

[21] Appl. No.: 525,161

[22] Filed: Sep. 8, 1995

[30] Foreign Application Priority Data

Sep. 8, 1994 [KR] Rep. of Korea ..... 22610/1994

[51] Int. Cl.[6] ..... G03G 15/06

[52] U.S. Cl. ..... 399/284; 399/149

[58] Field of Search ..... 355/200, 210, 355/245, 253, 259, 269, 270; 112/651–653; 430/109, 111, 120

[56] References Cited

U.S. PATENT DOCUMENTS

| | | | |
|---|---|---|---|
| 2,297,691 | 10/1942 | Carlson | 355/200 X |
| 3,985,436 | 10/1976 | Tanaka et al. | 355/200 |
| 4,462,677 | 7/1984 | Onoda | 355/210 |
| 4,470,689 | 9/1984 | Nomura et al. | 355/211 |
| 4,524,088 | 6/1985 | Fagen, Jr. et al. | 355/246 X |
| 4,538,897 | 9/1985 | Osaka et al. | 355/246 |
| 5,260,746 | 11/1993 | Yoshida et al. | 355/245 |
| 5,315,325 | 5/1994 | Strouth | 355/246 X |
| 5,387,965 | 2/1995 | Hasegawa et al. | 355/246 |
| 5,422,708 | 6/1995 | Morris et al. | 355/246 |

*Primary Examiner*—William J. Royer
*Attorney, Agent, or Firm*—Robert E. Bushnell, Esq.

[57] ABSTRACT

An electrophotographic process cartridge develops an electrostatic latent image with two layers or less of polymeric toner. The electrophotographic process cartridge includes a charging roller for uniformly distributing a layer of electrical charge on an outer surface of a photosensitive drum, a developing roller for transferring particles of polymeric toner each having a substantially spherical shape onto the outer surface of the photosensitive drum, and a control roller for engaging an outer surface of the developing roller to enable formation of two layers or less of polymeric toner particles on the outer surface of the developing roller. The particles of polymeric toner are transferred from the outer surface of the developing roller to the outer surface of the photosensitive drum for a printing operation, and remaining toner particles are transferred from the outer surface of the photosensitive drum back to the outer surface of the developing roller after the printing operation by a bias voltage applied to the developing roller.

15 Claims, 5 Drawing Sheets

ELECTROPHOTOGRAPHIC PROCESS CARTRIDGE

CROSS-REFERENCE TO RELATED APPLICATIONS

This application makes reference to, incorporates the same herein, and claims all benefits accruing under 35 U.S.C. §119 from an application for *Electrophotographic Process Cartridge* earlier filed in the Korean Industrial Property Office on 8 Sep. 1994 and there assigned Serial No. 22610/1994.

BACKGROUND OF THE INVENTION

The present invention relates to an electrophotographic process cartridge used in an elctrophotographic printing system such as a laser beam printer, a copying machine and a facsimile machine, and more particularly, to an electrophotographic process cartridge and a method for developing an electrostatic latent image with two layers or less of polymeric toner.

In general, a conventional electrophotographic process is performed using a photosensitive drum to obtain a hard copy by sequentially repeating a cycle of operations including charging, exposing, developing, transferring, cleaning and erasing, and fixing. This operation is referred to as the "Carlson process", and is disclosed in U.S. Pat. No. 2,297,691 issued to Carlson on Sep. 6, 1942. Further details of this process will be discussed later in this application.

One major concern in electrophotographic printing systems is toner waste. That is, during the electrophotographic printing process, only a portion of the total amount of developing material (i.e., toner) applied to a photosensitive element to effectuate the printing process is actually transferred onto a printable medium, such as paper. Accordingly, the portion of toner that is not transferred onto the printable medium remains as waste toner. Typically, the percentage of toner that is actually transferred during the electrophotographic printing process is referred to as the transfer rate. Obviously, it is quite desirable to maximize the transfer rate in an electrophotographic printing operation.

One recent effort that seeks to increase the transfer rate is disclosed in U.S. Pat. No. 5,422,708 entitled *Apparatus And Method For Metering Toner In Laser Printers* issued to Morris et al. on 6 Jun. 1995. In Morris et al. '708, a toner dispensing gap in a toner cartridge is set to within a particularly narrow range in an effort to thereby reduce the amount of toner that is released during the printing process. While this type of conventional art has some merit in its own right, we have discovered that this effort is premised upon its requirement for establishment and continued maintenance of an unnecessarily high degree of accuracy; consequently, we believe that an improved device can be contemplated.

SUMMARY OF THE INVENTION

Accordingly, it is an object of the present invention to provide an improved electrophotographic process cartridge.

It is another object to provide an electrophotographic process cartridge for preventing toner waste.

It is still another object to provide an electrophotographic process cartridge that avoids the need for a waste toner receptacle.

It is yet another object to provide an electrophotographic process cartridge that develops an electrostatic latent image using polymeric toner.

It is still yet another object to provide an electrophotographic process cartridge that develops an electrostatic latent image with two layers or less of polymeric toner.

These and other objects may be achieved according to the principles of the present invention with an electrophotographic process cartridge including a charging roller for uniformly distributing a layer of electrical charge on an outer surface of a photosensitive drum, a developing roller for transferring particles of polymeric toner each having a substantially spherical shape onto the outer surface of the photosensitive drum, and a control roller for engaging an outer surface of the developing roller to enable formation of two layers or less of polymeric toner particles on the outer surface of the developing roller. The particles of polymeric toner are transferred from the outer surface of the developing roller to the outer surface of the photosensitive drum, and are transferred from the outer surface of the photosensitive drum back to the outer surface of the developing roller by a bias voltage applied to the developing roller.

BRIEF DESCRIPTION OF THE DRAWINGS

A more complete appreciation of this invention, and many of the attendant advantages thereof, will be readily apparent as the same becomes better understood by reference to the following detailed description when considered in conjunction with the accompanying drawings, in which like reference symbols indicate the same or similar components, wherein.

DETAILED DESCRIPTION OF THE PREFERRED EMBODIMENT

Turning now to the drawings and referring to FIG. 1, an electrophotographic process will be described. First, a charging operation is performed for ionizing molecules of the air by a corona discharge, and for uniformly distributing a charge layer on a photosensitive drum. Second, an exposing operation is performed for selectively exposing the uniform charge layer on the photosensitive drum to a source of light, and for forming an electrostatic latent image on the photosensitive drum. Third, a developing operation is performed for selectively attaching toner to the photosensitive drum, thereby changing the electrostatic latent image to a visible image. Fourth, a transfer operation is performed for transferring the electrostatic latent image on the photosensitive drum to paper. Fifth, a cleaning and erasing operation is performed for removing the toner and electrostatic latent image remaining on the photosensitive drum. Finally, a fixing operation is performed for fixing the toner to the paper by heat and pressure.

As described above, after repeating the cycle of charging, exposing, developing, transferring, cleaning and erasing, and fixing in a sequential order, a hard copy is obtained. This operation is referred to as the "Carlson process", and is disclosed in U.S. Pat. No. 2,297,691 issued to Chester F. Carlson on 6 Oct., 1942.

Figure 1:
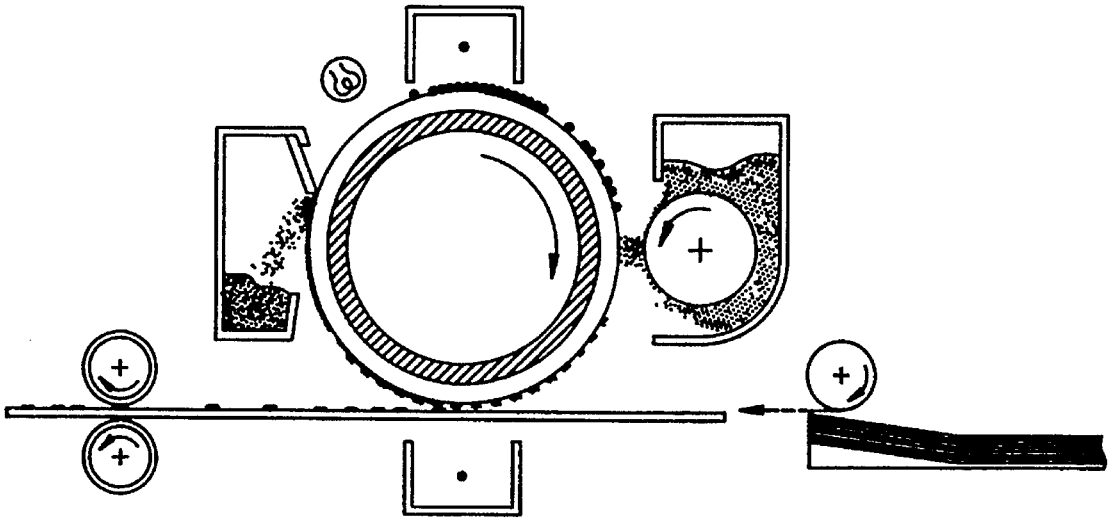
FIG. 1 (PRIOR ART)
FIG. 1 is a view showing an electrophotographic process cartridge of the type used in prior art devices.

As shown in FIG. 1, an electrophotographic process cartridge refers to the various components (i.e., the charger, the developer, the cleaner and other components) which are bundled as one integral unit. Representative technology related to the process cartridge is disclosed in U.S. Pat. Nos. 3,985,436, 4,538,897, 4,462,677 and 4,470,689.

With the electrophotographic process cartridges described in the foregoing paragraphs, we have discovered that significant problems exist because of the occurrence of toner waste.

When using a corona transfer unit, toner transfer efficiency is about 80%. Thus, in the case where 200 grams of toner is provided for a printing operation, only about 160 grams of toner is actually transferred onto the recording medium, and 40 grams of residual toner remains as the waste toner. Due to this 40 grams of waste toner, improvements in the design of process cartridges are needed.

For instance, when the photosensitive drum and developing roller of an electrophotographic process cartridge can be used to generate up to 15,000 copies, it is economical to design a process cartridge so that an exhausted cartridge can be exchanged for a new cartridge. We have found that the occurrence of toner waste places limits on the design of such a process cartridge.

Typically, it is possible to generate approximately 3,000 copies with 200 grams of toner. Accordingly, 1000 grams of toner is required to generate 15,000 copies. In this latter situation, if the toner transfer efficiency is 80%, the amount of the toner waste occurring from 1000 grams of toner is 200 grams (i.e., 1000 grams×0.2=200 grams). Assuming the density of toner is 0.6 grams/$cm^3$, a waste toner receptacle having a volume of about 333 $cm^3$ (i.e., 200 g÷0.6 g/$cm^3$= 333 $cm^3$) is required. In practice however, the waste toner receptacle must be even larger than this, in case any variances should occur. Accordingly, the size and production cost of the process cartridge is concomitantly increased.

Figure 3:
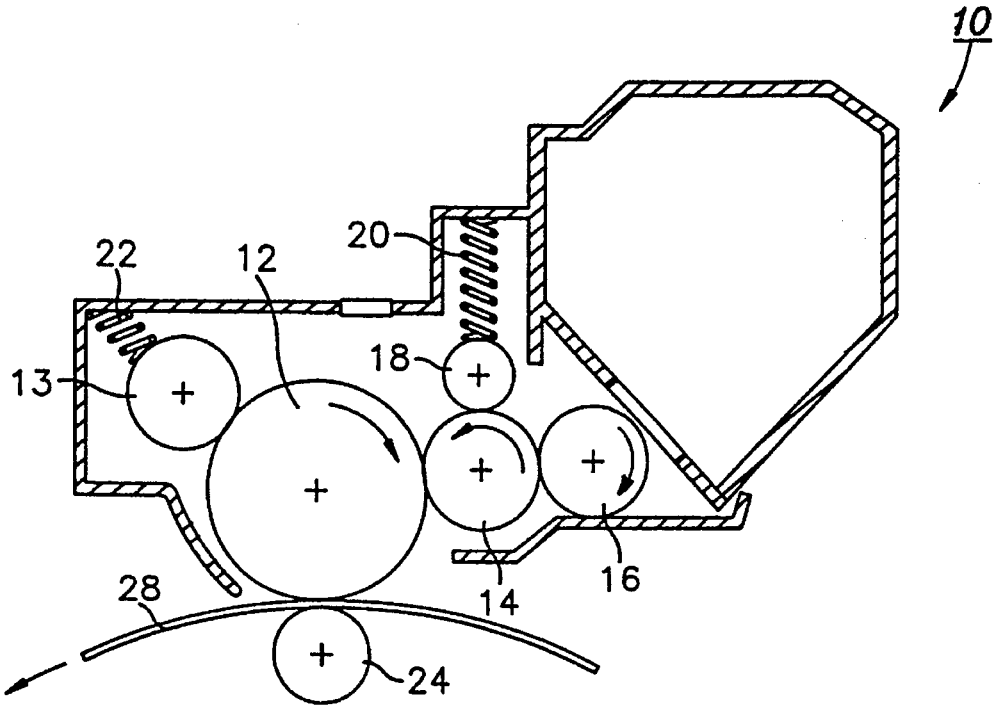
FIG. 3 is a sectional view showing an electrophotographic process cartridge constructed according to the principles of the present invention.

Referring now to FIG. 3, a preferred embodiment of the present invention will be described in detail. An electrophotographic process cartridge 10 constructed according to the principles of the present invention utilizes polymerized toner 26, wherein each particle has a substantially spherical shape so as to develop an electrostatic latent image on a photosensitive drum 12 with two or less layers of toner. A control roller 18 engages a first developing roller 14 so that polymeric toner 26 can be formed into two layers or less, and a charging roller 13 electrically charges the exterior circumferential photosensitive surface of drum 12.

Polymeric toner 26 differs from pulverulent toner used in conventional copier machines and laser beam printers. A process for making pulverulent toner will be hereinafter explained. First, after dissolving carbon in a furnace having a temperature of about 200°~250° C., the dissolved carbon having a linear shape is extracted and pulverized so that each particle has a substantially spherical shape and a diameter of about 2~3 millimeters. Secondly, the toner is pulverized again by passing through an air-jet at a high speed and colliding against a metal plate. Finally, the pulverized toner is filtered, and the resultant toner has a diameter of about 10~12 micrometers (μm).

Even though the pulverulent toner described above is produced so that each particle has a diameter of about 10 μm, toner particles having a diameter larger or smaller than 10 μm may be produced. Also, it is noted that particles of pulverulent toner often have an arbitrary shape. Accordingly, we have found that it is difficult to develop an electrostatic latent image on the exterior circumferential photosensitive surface of drum 12 with pulverulent toner having two layers or less when the toner particles have an arbitrary shape.

Therefore, the present invention uses polymeric toner 26, wherein each particle has a substantially spherical shape, in order to develop the electrostatic latent image on photosensitive drum 12 with two layers or less of toner.

Polymeric toner 26 is produced through a polymerization reaction where carbon is dissolved with an additive in water. According to this process, results such as: uniform distribution of the additive, a substantially spherical shape of the polymeric toner particles, excellent transfer efficiency, and easy control over an amount of particle charging by adjusting the amount of the additive, can be achieved.

According to the present invention, it is possible to produce polymeric toner 26, wherein each particle has a diameter of about 8 μm, by adjusting the temperature and time of the polymerization reaction.

Figure 2:
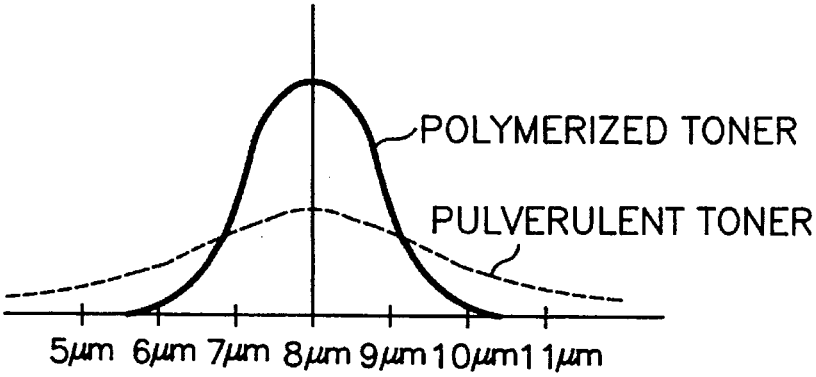
FIG. 2 is a view showing a distribution of particle sizes of polymeric and pulverulent toner.

Referring now to FIG. 2, a view of the distribution of particle sizes of polymeric toner 26 and the pulverulent toner is illustrated. While polymeric toner 26 shows a distribution of particle sizes over a generally narrow range between 6 and 10 micrometers with a principal concentration of particles between 7 and 9 micrometers, the pulverulent toner shows a relatively wide distribution of particle sizes varying from well less than 5 micrometers to more than 4 micrometers.

According to the principles of the present invention, polymeric toner 26 of two layers or less is formed on a first developing roller 14, so as to develop the polymeric toner 26 on photosensitive drum 12. To this end, first developing roller 14 is manipulated by a control roller 18 and a first press unit 20 that applies a predetermined downwardly directed force upon control roller 18.

As mentioned previously, electrophotographic process cartridge 10 develops polymeric toner 26 having two layers or less on photosensitive drum 12. Cartridge 10 uses a charging roller 13 that generates a uniform charge layer on the surface of photosensitive drum 12 and an exposing unit that forms an electrostatic latent image on photosensitive drum 12 by selectively exposing the uniform charge layer on photosensitive drum 12 to light. Charging roller 13 is installed to engage one side of photosensitive dram 12. A second press unit 22, such as a coil spring, applies a force upon charging roller 13 in a direction towards photosensitive drum 12.

The developing operation where polymeric toner 26 selectively adheres to photosensitive drum 12 is performed by first developing roller 14. First developing roller 14 is rotatably installed and engages one side of photosensitive drum 12. Control roller 18 for controlling the dispersion of polymeric toner 26 is installed at an upper portion of first developing roller 14. First press unit 20 applies a force upon control roller 18 in a direction towards first developing roller 14. First press unit 20 can be replaced by a coil spring. Elastic materials capable of applying a force upon control roller 18 may also be used. In the preferred embodiment of the present invention, the force exerted upon control roller 18 by first press unit 20 is between 4.9 and 19.6 Newtons (i.e.; (0.5 kg)(9.8 m/s$^2$)=4.9 Newtons, (2 kg)(9.8 m/s$^2$)=19.6 Newtons)

On one side of first developing roller 14, a second developing roller 16 is rotatably installed to convey polymeric toner 26 to first developing roller 14.

On a bottom side of photosensitive drum 12, a transfer roller 24 is installed to transmit the visible image of photosensitive drum 12 onto a recording medium 28, such as paper. Transfer roller 24 has a metal core and a conductive rubber outer surface, preferably, acrylonitrile-butadience rubber (NRB).

Figure 5:
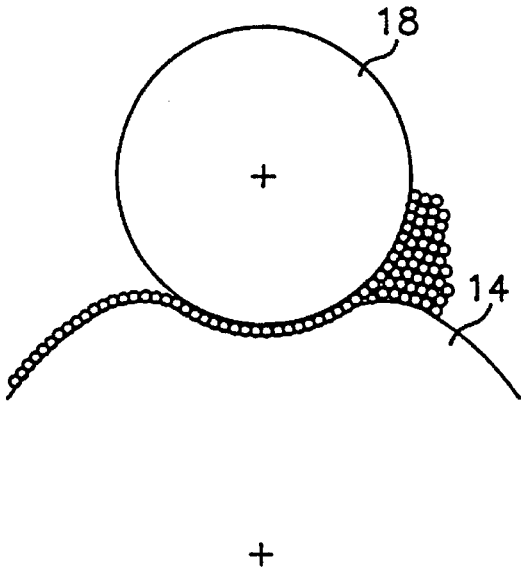
FIG. 5 is a cross-sectional view showing toner being passed between a first developing roller and a control roller of FIG. 3.

When first press unit 20 applies the predetermined force upon control roller 18, a layer of polymeric toner 26 is formed between control roller 18 and an outer surface of first developing roller 14, as is shown in FIG. 5. Control roller 18 is formed as a cylindrical bar having a diameter of approximately 4 to 10 millimeters. First developing roller 14 is composed of acrylonitrile-butadience rubber (NRB) and exhibits between 20 and 40 degrees of surface hardness.

At this time, as first developing roller 14 rotates, polymeric toner 26, adhering to the surface of first developing roller 14 passes between control roller 18 and first developing roller 14. The force applied upon control roller 18 by first press unit 20 controls the amount of polymeric toner 26 that passes between control roller 18 and first developing roller 14. Accordingly, two layers or less of polymeric toner 26 pass between control roller 18 and first developing roller 14.

In the practice of the present invention, polymeric toner 26 may be used with the composition of the toner having each particle with a diameter between 5 μm and 8 μm. Control roller 18, composed of stainless steel, has a 8 mm diameter and is applied with a force having a magnitude between 4.9 Newtons and 19.6 Newtons in a direction towards first developing roller 14. With this configuration, it has been observed under a microscope that the polymeric toner 26 passed between control roller 18 and first developing roller 14 is evenly distributed in essentially one layer.

The magnetic brush developing method is a well-known conventional developing method. The magnetic brush developing method uses a magnetic brush to apply a layer of a monocomponent or dual component toner upon a photosensitive drum.

After layers of the monocomponent toner pass through a control blade in the magnetic brush developing method, the toner is transferred onto the outer surface of the photosensitive drum, and the height of toner layers is generally more than 0.3 mm. Assuming that the size of each particle of monocomponent toner is 10 μm, the number of toner layers is 30.

On the other hand, since a gap between the photosensitive drum and a developing roller may be as close as 1 mm in the magnetic brash developing method when a dual component toner is used, the height of toner layers when a dual component toner is used is much greater than when a monocomponent toner is used.

Figure 6:
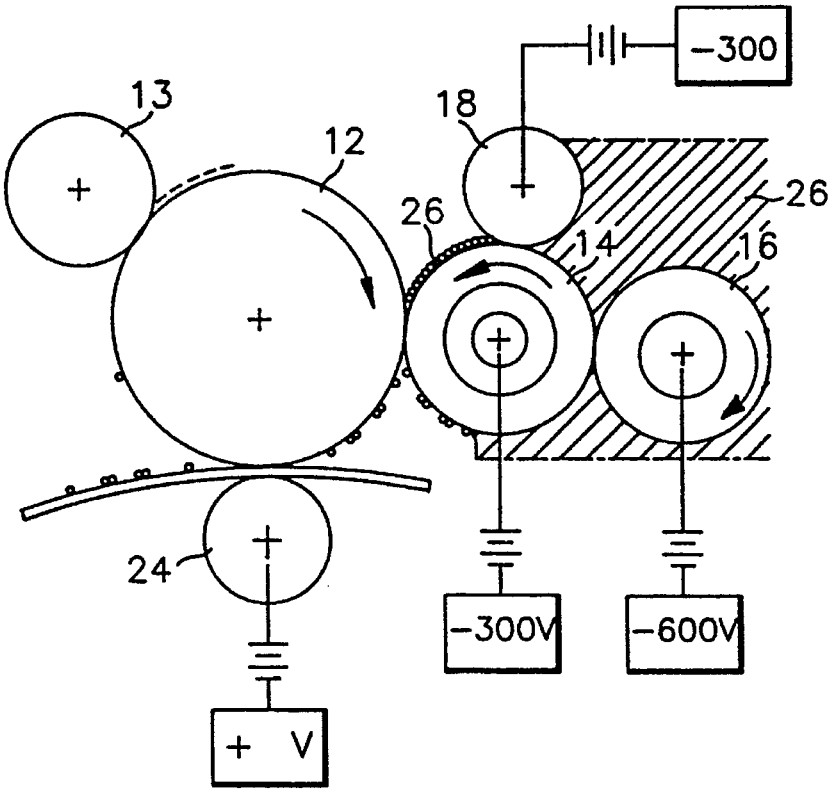
FIG. 6 is a schematic view showing bias voltages applied to each of the rollers of FIG. 3.

As shown in FIG. 5 and FIG. 6, when the predetermined force is applied downwardly upon control roller 18, polymeric toner 26 passes between first developing roller 14 and control roller 18 and forms in two layers or less upon the outer surface of first developing roller 14. Therefore, when first developing roller 14 contacts photosensitive drum 12 during rotation, polymeric toner 26 on the outer surface of first developing roller 14 is transferred onto the electrostatic latent image formed on photosensitive drum 12 by a bias voltage applied to first developing roller 14.

Figure 4:
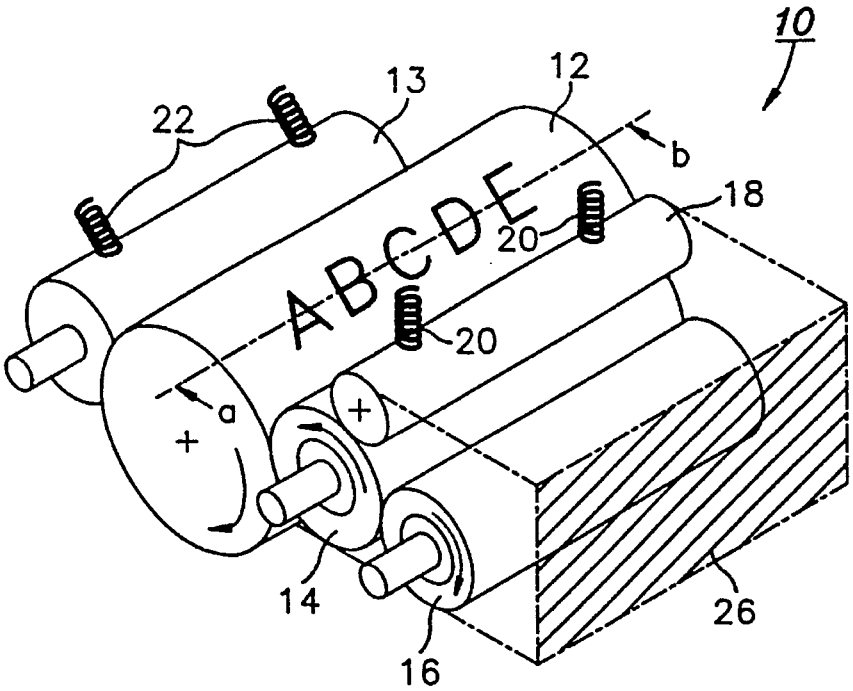
FIG. 4 is a perspective view showing the main portions of FIG. 3.
Figure 7:
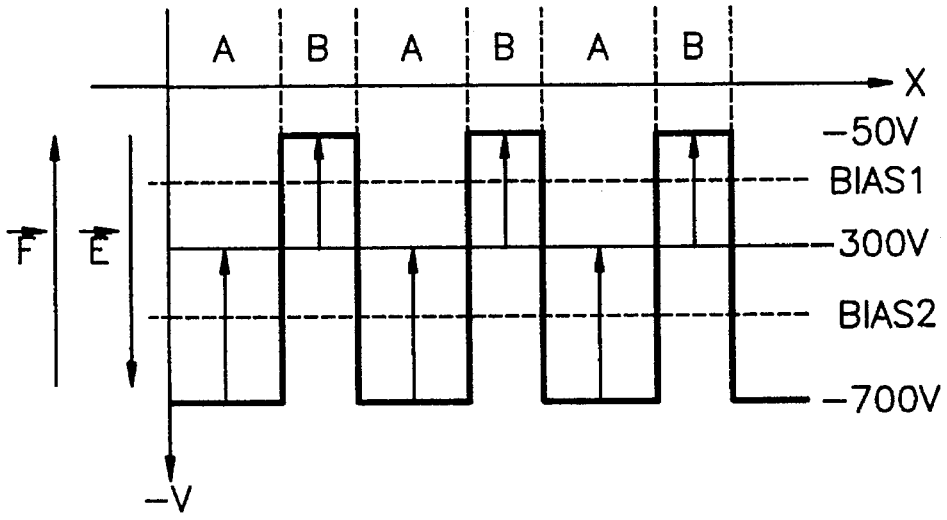
FIG. 7 is a two coordinate diagrammatic view showing the force generated according to Coulomb's Law in FIG. 6.

The electric potential on photosensitive dram 12 along the dotted line extending from "a" to "b" (i.e., line ABCDE) of FIG. 4 is illustrated in FIG. 7. The force from an electric field applied to polymeric toner 26 is defined by F=qE according to Coulomb's Law. In the present invention, polymeric toner 26 has a charge density of about 20 to 40 μC/g.

As shown in FIG. 7, the voltage for exposure areas B, is between −50 Volts and −300 Volts, and the voltage for non-exposure areas A is between −300 Volts and −700 Volts.

The electrophotographic process cartridge constructed according to the principles of the present invention wherein no waste toner receptacle is needed will now be explained. Referring now to FIG. 4 and FIG. 6, charging roller 13 charges photosensitive drum 12, and two or less layers of polymeric toner 26 are formed on first developing roller 14. Then, when photosensitive drum 12 rotates in contact with first developing roller 14, as depicted in FIG. 6, polymeric toner 26 is applied to photosensitive drum 12.

Then, as shown in FIG. 6, recording medium 28 passes between photosensitive drum 12 and transfer roller 24. Since a positive voltage is applied to transfer roller 24, a vast majority of polymeric toner 26 on the outer surface of photosensitive drum 12 is transferred onto recording medium 28 and only a small amount of polymeric toner 26 remains on photosensitive drum 12.

In the present invention, polymeric toner 26 is used since it can be produced so that the size of its particles is generally uniform. Also, since particles of polymeric toner 26 do not have opposite polarities, a favorable transfer efficiency in the range of 95–98% is achieved with the present invention. Accordingly, the amount of polymeric toner 26 remaining on photosensitive drum 12 is only about 2–5% of the total amount of polymeric toner 26 applied to photosensitive drum 12. Moreover, since the polymeric toner 26 is formed in two layers or less, quantities of polymeric toner 26 remaining on photosensitive drum 12 can be retrieved by first developing roller 14 according to Coulomb's Law when the polymeric toner 26 returns back at first developing roller 14 after passing charging roller 13. Even though this excess polymeric toner 26 has been exposed, re-use of the polymeric toner 26 has no adverse influence on the generation of other hard copies.

Coulomb's Law also applies in the conventional magnetic brush development method. With this conventional method, however, several tens of layers of polymeric toner 26 are formed on first developing roller 14. As a result, it is difficult to thoroughly retrieve all quantities of polymeric toner 26 remaining on photosensitive drum 12 after transferring polymeric toner 26 onto recording medium 28.

With the present invention, however, characteristics such as: particles of polymeric toner 26 having a substantially spherical shape, excellent charging ability, control over polymeric toner 26 particle size and an amount of charging, the formation of polymeric toner 26 in two layers or less on first developing roller 14, and retrieval of almost all of the polymeric toner 26 remaining on photosensitive drum 12, can be obtained.

As indicated by FIG. 7, the bias voltage applied to first developing roller 14 may be selected as a value higher or lower than −300 Volts. If the bias voltage is selected as a value greater than −300 Volts (i.e., adjusted upwardly towards −50 Volts into the Bias 1 region), the developing operation between first developing roller 14 and photosensitive drum 12 may deteriorate. However, the ability of first developing roller 14 to retrieve polymeric toner 26 particles from photosensitive drum 12 improves.

Alternatively, if the bias voltage is selected as a value lower than −300 Volts (i.e., adjusted downwardly towards −700 Volts into the Bias 2 region), the developing operation between first developing roller 14 and photosensitive drum 12 improves, but the ability of first developing roller 14 to retrieve polymeric toner 26 particles from photosensitive drum 12 deteriorates.

According to a preferred embodiment of the present invention, for cases where the electrical potential along the surface of photosensitive drum 12 is −700 Volts, and becomes −50 Volts after exposure, it is noted that the bias voltage is approximately −300 Volts, plus or minus 50 Volts.

Figure 8A:
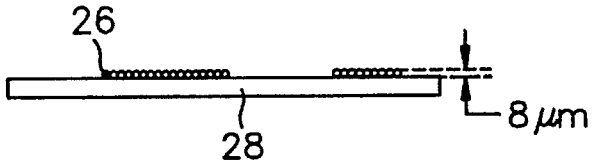
FIGS. 8A and 8B arc cross-sectional views illustrating the transfer of toner onto paper in an electrophotographic process cartridge constructed according to the principles of the present invention, and in an electrophotographic process cartridge suitable for use with a conventional magnetic brush developing method, respectively.
Figure 8B:
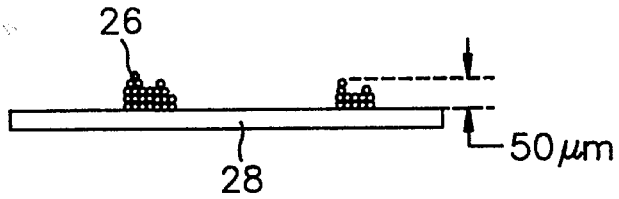
FIG. 8B (PRIOR ART)

Effects of the present invention as compared to the conventional art will now be described with reference to FIGS. 8A and 8B. According to the present invention, polymeric toner 26 is distributed onto recording medium 28 in two layers or less, as shown in FIG. 8A. With the conventional art, on the other hand, polymeric toner 26 is distributed onto recording medium 28 in several layers, as shown in FIG. 8B. That is, the height of layers of polymeric toner 26 in the conventional art is approximately 50 μm, as shown in FIG. 8B.

The standard for evaluating the quality of a printed image is not based on how much toner has been formed on a recording medium, but rather how uniformly the toner has been formed.

In the conventional art shown in FIG. 8B, a relatively large quantity of polymeric toner 26 is formed on recording medium 28. When this distribution of polymeric toner 26 is measured with an optical densitometer, the surface of recording medium 28 does not have as high a degree of uniformity as the present invention. That is, since polymeric toner 26 is uniformly formed on the surface of recording medium 28 in the present invention, a higher degree of toner density is achieved with a smaller amount of polymeric toner 26 than is used in the conventional art.

When printing a 4% character pattern with electrophotographic process cartridge 10 according to the present invention, the amount of polymeric toner 26 used to print one page is about 22 milligrams. On the other hand, when printing a 4% character pattern with the conventional magnetic brash development method, the amount of polymerized toner 26 used to print one page is about 55 milligrams. Accordingly, toner consumption in the present invention is less than in the conventional art.

Moreover, since waste toner (i.e., unusable toner remaining on photosensitive drum 12 after printing) is not generated, the present invention prevents toner from being wasted and prevents the environment from being polluted. Furthermore, since a waste toner receptacle is not required, the electrophotographic process cartridge can be freely designed.

Figure 9:
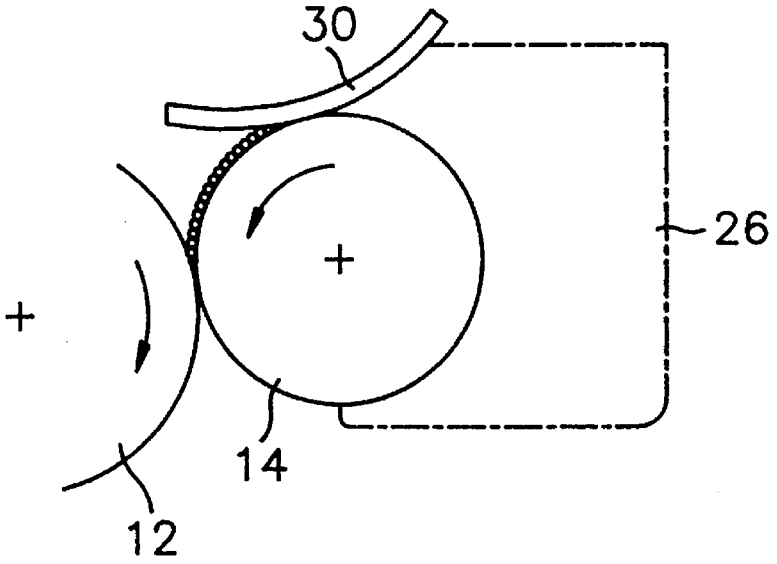
FIG. 9 is a cross-sectional view showing another embodiment of an electrophotographic process cartridge constructed according to the principles of the present invention.
Figure 10:
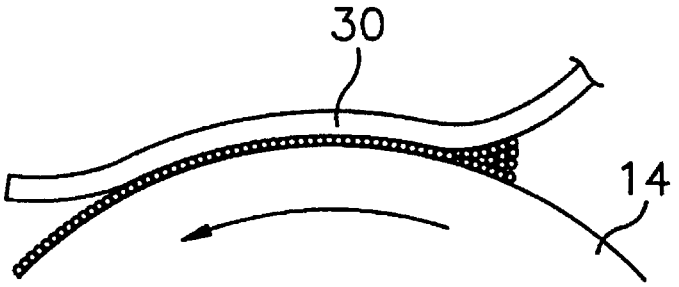
FIG. 10 is a view showing toner being passed between urethane rubber and a first developing roller of the apparatus illustrated in FIG. 9.

In another embodiment of the present invention, as shown in FIGS. 9 and 10, urethane rubber 30 having a hemispherical shape is used as control roller 18 in the previous embodiment to form polymeric toner 26 in two layers or less on first developing roller 14. When first developing roller 14 rotates, since polymeric toner 26 has a substantially spherical shape, the polymeric toner 26 passes between urethane rubber 30 and first developing roller 14. The size of the particles of polymeric toner 26, the roughness of the surface of first developing roller 14, and the force applied to first developing roller 14 are carefully determined, as in the previous embodiment, in order to form polymeric toner 26 in two layers or less on first developing roller 14.

While there have been illustrated and described what are considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation to the teaching of the present invention without departing from the central scope thereof. Therefore, it is intended that the present invention not be limited to the particular embodiments disclosed as the best mode contemplated for carrying out the present invention, but that the present invention includes all embodiments falling within the scope of the appended claims.

What is claimed is:

1. An electrophotographic process cartridge, comprising:

a photosensitive drum;

charging means for uniformly distributing a layer of electrical charge on an outer surface of said photosensitive drum;

a developing roller for transferring particles of polymeric toner each having a substantially spherical shape onto said outer surface of said photosensitive drum; and control means for engaging an outer surface of said developing roller to enable formation of two layers or less of said particles of said polymeric toner on said outer surface of said developing roller, said particles of said polymeric toner being transferred from said outer surface of said developing roller to said outer surface of said photosensitive drum and being transferred from said outer surface of said photosensitive drum back to said outer surface of said developing roller in dependence upon a voltage applied to said developing roller.

2. The electrophotographic process cartridge as claimed in claim 1, wherein said developing roller comprises conductive acrylonitrile-butadience rubber.

3. The electrophotographic process cartridge as claimed in claim 2, wherein said developing roller has approximately 20~40 degrees of surface hardness.

4. The electrophotographic process cartridge as claimed in claim 1, wherein said control means comprises a cylindrical roller having a diameter of approximately 4 to 10 millimeters.

5. The electrophotographic process cartridge as claimed in claim 1, wherein said control means comprises a hemispherical portion of rubber.

6. The electrophotographic process cartridge as claimed in claim 5, wherein said hemispherical portion of rubber comprises urethane rubber.

7. The electrophotographic process cartridge as claimed in claim 1, further comprised of means for applying a predetermined force upon said control means so that said control means engages said outer surface of said developing roller and enables said formation of said two layers or less of said particles of said polymeric toner on said outer surface of said developing roller.

8. The electrophotographic process cartridge as claimed in claim 7, wherein said predetermined force exhibits a magnitude having a range from approximately 4.9 Newtons to 19.6 Newtons.

9. The electrophotographic process cartridge as claimed in claim 7, wherein said means for applying said predetermined force comprises a coil spring.

10. An electrophotographic process cartridge, comprising:

a photosensitive drum;

charging means for uniformly distributing a layer of electrical charge on an outer surface of said photosensitive drum;

a developing roller for transferring particles of polymeric toner each having a substantially spherical shape onto said outer surface of said photosensitive drum; and a control roller for receiving a predetermined force enabling said control roller to engage an outer surface of said developing roller and form two layers or less of said particles of said polymeric toner on said outer surface of said developing roller, said particles of said polymeric toner being transferred from said outer surface of said developing roller to said outer surface of said photosensitive drum and being transferred from said outer surface of said photosensitive drum back to said outer surface of said developing roller in dependence upon a voltage applied to said developing roller.

11. The electrophotographic process cartridge as claimed in claim 10, wherein said predetermined force exhibits a magnitude having a range from approximately 4.9 Newtons to 19.6 Newtons.

12. The electrophotographic process cartridge as claimed in claim 11, wherein said predetermined force is received by said control roller from a coil spring.

13. The electrophotographic process cartridge as claimed in claim 10, wherein said developing roller comprises conductive acrylonitrile-butadience rubber.

14. The electrophotographic process cartridge as claimed in claim 13, wherein said developing roller has approximately 20~40 degrees of surface hardness.

15. An electrophotographic process, comprising the steps of:

transferring polymeric toner onto an outer surface of a developing roller;

engaging said outer surface of said developing roller to form two layers or less of said polymeric toner upon said outer surface of said developing roller;

transferring said two layers or less of said polymeric toner from said outer surface of said developing roller to an outer surface of a photosensitive drum by applying a bias voltage to said developing roller;

transferring first portions of said two layers or less of said polymeric toner from said outer surface of said photosensitive drum onto a surface of a printable medium as said printable medium passes between said photosensitive drum and a transfer roller; and then transferring second portions of said two layers or less of said polymeric toner remaining on said outer surface of said photosensitive drum from said outer surface of said photosensitive drum back to said outer surface of said developing roller by applying said bias voltage to said developing roller.

* * * * *